United States Patent [19]

Oliphant

[11] Patent Number: 4,854,547

[45] Date of Patent: Aug. 8, 1989

[54] VEHICLE-MOUNTED RETRIEVAL WINCH AND CONTROL MEANS THEREFOR

[75] Inventor: Larry J. Oliphant, Swisher, Iowa

[73] Assignee: Harnischfeger Corporation, Brookfield, Wis.

[21] Appl. No.: 88,809

[22] Filed: Aug. 24, 1987

[51] Int. Cl.[4] ..... B66D 1/08; B66D 1/22; B66D 1/50

[52] U.S. Cl. ..... 254/271; 254/326; 254/344; 254/356; 254/361

[58] Field of Search ..... 254/270, 271, 274, 275, 254/276, 281, 284, 297, 315, 316, 273, 323, 325, 326, 335, 344, 356, 361, 362, 375, 379

[56] References Cited

U.S. PATENT DOCUMENTS

| | | | |
|---|---|---|---|
| 2,391,580 | 12/1945 | Mackmann et al. | 254/361 X |
| 3,309,066 | 3/1967 | Carlson et al. | 254/276 X |
| 3,319,492 | 5/1967 | Magnuson | 254/361 X |
| 3,606,257 | 9/1971 | Wilson | 254/271 |
| 4,508,281 | 4/1985 | Plater | 254/361 X |

FOREIGN PATENT DOCUMENTS

| | | | |
|---|---|---|---|
| 2758079 | 7/1979 | Fed. Rep. of Germany | 254/271 |
| 2922421 | 12/1980 | Fed. Rep. of Germany | 254/271 |

*Primary Examiner*—Joseph J. Hail, III

*Attorney, Agent, or Firm*—Richard C. Ruppin

[57] ABSTRACT

A compact retrieval winch and a control therefor are mounted on a recovery vehicle for pulling an immobilized heavy vehicle, such as a military tank, back onto suitable terrain. The winch comprises a support structure, a rotatable hollow cable drum with a cable wrapped thereon, a reversible variable displacement hydraulic motor for driving the drum through a multistage power transmission mechanism located within the drum, and a drum brake. The winch control comprises a sensing mechanism for sensing the number of layers of winch cable wrapped on the drum while the drum is operating in the pulling mode and the cable is connected to the tank. The winch control further comprises a hydraulic control circuit, including a constant line pull valve assembly responsive to movement of the sensing mechanism, for controlling the displacement of the hydraulic motor so as to maintain constant maximum cable pulling force regardless of the number of layers of cable on the cable drum.

9 Claims, 7 Drawing Sheets

VEHICLE-MOUNTED RETRIEVAL WINCH AND CONTROL MEANS THEREFOR

BACKGROUND OF THE INVENTION

1. Field of Use

This invention relates generally to winches and control means therefor. In particular, it relates to a retrieval winch which is mounted on a recovery vehicle and employed to pull an immobilized second vehicle free of unsuitable terrain.

2. Description of the Prior Art

Certain types of military tanks are extremely heavy (on the order of 70 tons) and, if maneuvered onto terrain unable to support their weight, sink in, cannot free themselves and become immobilized. In view of this problem, recovery vehicles are made available to pull the immobilized tank back onto suitable terrain. A typical recovery vehicle takes the form of a self-propelled, crawler-type, armored, manned vehicle having a retrieval winch mounted inside the recovery vehicle and also having a spade mounted on the outside of the front of the recovery vehicle. The spade, which is similar to a long narrow bulldozer blade, is lowered and dug into the earth to maintain the recovery vehicle stationary while a winch cable extending from the recovery vehicle is paid-out, attached to the immobilized tank, and then reeled in to pull the tank back onto suitable terrain. The maximum pulling force required to free the tank is very great and can exceed the weight of the tank. This force is imposed on the winch cable, on the winch and the support structure by which the winch is mounted on the recovery vehicle, and these components must be very strong mechanically.

Typically, such a retrieval winch comprises a support structure attached to the inside of the recovery vehicle, a winch drum rotatably mounted on the support structure, a winch cable having one end attached to the drum and wrapped therearound in multiple layers, a reversible winch motor mounted on the support structure for rotating the drum, a speed reduction transmission connected between the winch motor and winch drum, a normally-engaged, releasable drum brake assembly mounted on the support structure and connected to the winch drum to stop drum rotation, and a control system selectively operable to release the drum brake and operate the winch motor in the appropriate direction so as to pay-out or pull-in the winch cable. Typically, the winch motor is a single or dual displacement, reversible hydraulic motor, and the control system is hydraulic because hydraulic systems can provide high power but are relatively uncomplicated and easy to maintain and service. However, electric winch motors and control systems therefor can be employed.

A prior art retrieval winch of the aforesaid character which uses a single displacement hydraulic motor and a prior art control system therefor has an operating characteristic which necessitates that the winch components, support structure, and wire rope be designed and built so as to exert and withstand a pulling force which is substantially greater than that actually required to pull a load (i.e., free the immobilized tank) of given weight. In particular, in a single displacement hydraulic motor wherein maximum hydraulic fluid flow and pressure differential across the motor are constant, maximum motor torque and motor speed are also constant. When such a motor is connected to drive a winch on which the number of layers of cable on the winch drum increase as a cable attached to a load of given weight is pulled in, the following phenomena occurs. As the first layer of cable is formed, the first cable layer is a certain distance from the axis of drum rotation, the motor exerts a certain torque at a certain speed, and the available pulling force on the cable is at maximum and sufficient to pull the load. However, as the second layer of cable is formed, the second cable layer is at an increased distance from the axis of drum rotation, and because of this mechanical advantage (i.e., an effective lever arm of increased length), the load is "seen" by the winch motor as having increased. The winch is no longer capable of pulling the load. Thus, increased torque (above the maximum required when wrapping the first cable layer) is required from the motor. As each successive layer of cable is formed on the drum, the pulling force is proportionally decreased. As a result, the winch components must be designed to withstand the greatest force imposed thereon when a single layer of cable is formed on the drum, even though this greatest pulling force is substantially greater than the maximum force actually produced on successive cable layers. A winch designed to be capable of producing adequate cable pull on the outer most layer, must accommodate rope size and have structural integrity sufficient for the maximum line pull produced on the first layer.

As a result, a prior art retrieval winch of the aforesaid character tends to be relatively large physically because of the great pulling forces to which it is subjected and because of the manner in which the various prior art winch components are designed and arranged. It is desirable, however, that a retrieval winch installed inside of a recovery vehicle where space is at a premium be as small as practical but sufficiently powerful to do the job.

SUMMARY OF THE PRESENT INVENTION

A winch and control means therefor in accordance with the invention is designed and constructed to exert and maintain a constant maximum pulling force on a load connected to the winch cable, regardless of the number of layers of winch cable being formed on the winch cable drum. The winch and control means are especially well-adapted to be mounted on a recovery vehicle and employed as a retrieval winch which is used, for example, to move a heavy vehicle, such as a military tank, which is entrapped and immobilized in terrain unable to bear its weight. However, the winch and control means therefor could have other uses.

Generally considered, a winch in accordance with the invention comprises a support structure comprising a pair of spaced apart support members, a hollow cylindrical winch cable drum rotatably supported on and between the support members, a reversible motor mounted on one of the support members and of a type in which motor displacement and resulting torque can be varied, a power transmission means mounted within the hollow cable drum and operatively connected between the motor and drum, and releasable drum brake means mounted on the other of the support members and operatively connected to the power transmission means to selectively permit or stop drum rotation.

The said one support member has an inwardly extending recess in which the motor is mounted to thus conserve space and achieve a winch of more compact width.

The power transmission means comprises a power transmission shaft rotatably mounted on and between the pair of spaced apart support members within the hollow drum and having one end operatively connected to be driven by the motor. The power transmission means further comprises a multi-stage transmission mechanism mounted within the hollow drum and operatively connected between the power transmission shaft and the drum. Each stage has gears which mesh with ring gears mounted on the inside of the drum.

The drum brake means comprise a rigid brake housing in which a set of fixed brake discs and an interleaved set of rotatable brake discs are located. The fixed set is connected to and supported by the brake housing. The rotatable set is connected to, supported by and rotatable with the other end of the power transmission shaft. The brake housing is connected to the other one of the pair of support members by bolts which extend into bolt-receiving bores. Each such bore is formed in the brake housing, in the said other support member and in a stationary member forming part of the last stage of the power transmission mechanism to enhance the strength of the mechanical connection of the brake housing to its associated support plate without sacrificing winch width compactness. Each bore extends inwardly parallel to the axis of rotation of the power transmission shaft so that it can accommodate a bolt with a longer threaded section than would otherwise be possible.

Generally considered, the control means for the winch comprise a motor control operable to adjustably vary the displacement of the winch motor, and sensing means or mechanism to determine the number of layers of cable wrapped on said winch cable drum and to operate said motor control in accordance therewith so that the winch motor operates to maintain a constant pulling force on the winch cable and load attached thereto, regardless of the number of layers of cable on the winch drum. The sensing means or mechanism comprises a sensing member movably supported on at least one support member of the winch and is adapted for connection to the motor control. The sensing means further comprises biasing means for biasing the sensing member into engagement with the cable extending from the winch drum so that a change in the number of layers of cable on said drum effects movement of said sensing member. The control means also operates the winch brake.

In a preferred embodiment of the invention disclosed herein, the motor is a reversible variable displacement hydraulic motor having a built-in displacement control circuit which includes a control override displacement port responsive to fluid pressure thereat to vary motor displacement. The control means for the winch includes this built-in control circuit, as well as an additional hydraulic control circuit comprising a constant line pull valve assembly which is responsive to movement of the cable layer sensing member. The constant line pull valve assembly effects an incremental increase in hydraulic control fluid pressure at the control port as each layer of cable is added to the drum so as to increase motor displacement and increase motor torque and thereby maintain a constant line pull force on a cable attached to a load, regardless of the number of layers of cable on the drum.

A winch and control means therefor in accordance with the present invention offers several advantages over the prior art. For example, the winch is relatively compact because of the arrangement and construction of its components. The winch is designed and constructed to exert and withstand a maximum known cable pulling force and need not withstand additional increased pulling forces which are prevented from occurring even though the number of cable layers increases. The control means is simple, reliable and foolproof and economical to manufacture. The cable layer sensing means and the constant line pull valve assembly are simple and compact in construction and accurate and reliable in operation.

Other objects and advantages of the invention will hereinafter appear.

DRAWINGS

DESCRIPTION OF THE PREFERRED EMBODIMENTS

Figure 1:
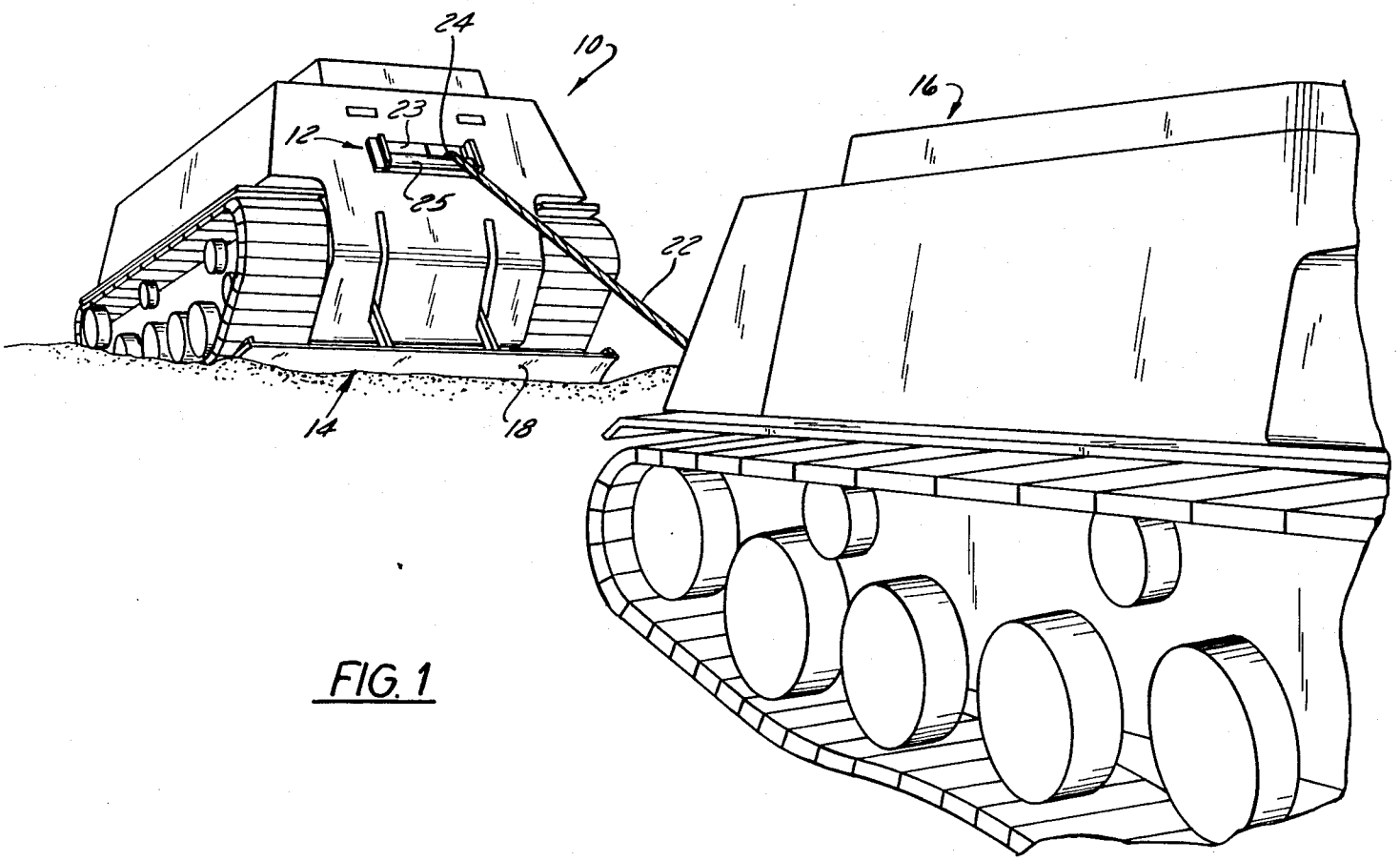
FIG. 1 is a perspective view of a recovery vehicle having a retrieval winch therein (not visible) and control means therefor (not visible) in accordance with the invention and showing the winch cable connected to a vehicle to be recovered.

FIG. 1 shows a recovery vehicle 10 having a main winch, including a cable 22, and a spade assembly 14 at its front end. Vehicle 10 is employed, for example, to retrieve or recover another vehicle 16, such as a large military tank (on the order of 70 tons in weight), which is immobilized in unsuitable terrain, and needs to be pulled back onto terrain which can support its weight.

Spade assembly 14 comprises a spade 18 in the form of a narrow blade which is mounted on laterally spaced apart arms which can be selectively swung up or down by hydraulic rams (not shown) inside recovery vehicle 10 to raise and lower the spade. When lowered, spade 18 digs into the terrain to maintain recovery vehicle 10 stationary and prevent it from moving forward when main winch assembly 12 is operated so that winch cable 22 thereof exerts a pulling force on vehicle 16 to which it is attached.

Main winch assembly 12 generally comprises exterior and interior components mounted on the outside and inside, respectively, of the front end of recovery vehicle 10.

Figure 3:
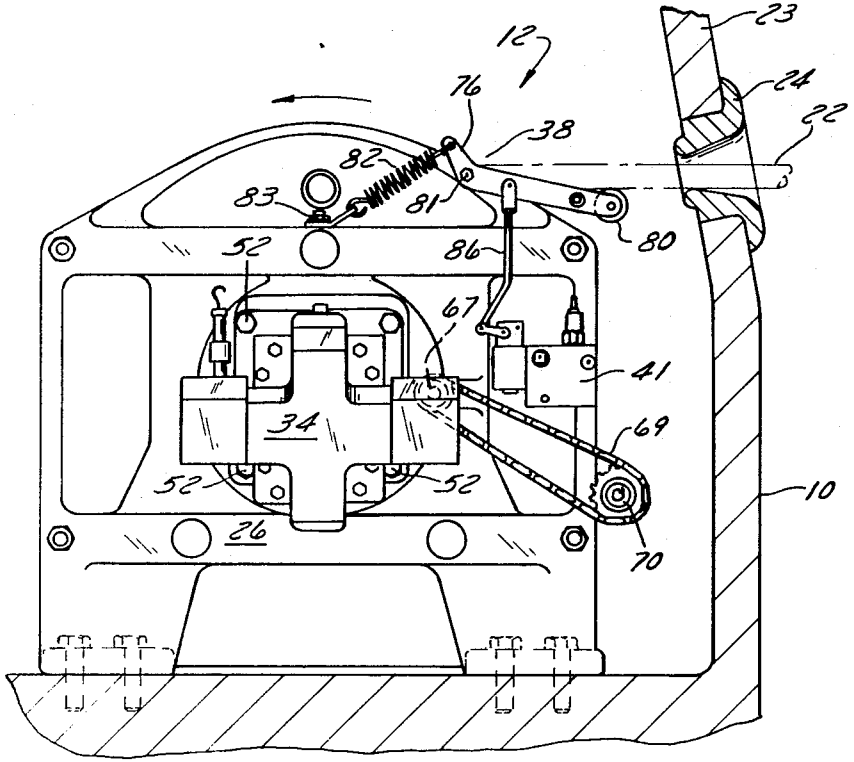
FIG. 3 is a left side elevation view of the winch of FIG. 2.

As FIG. 1 shows, the exterior components of main winch assembly 12 include a mounting plate 23 rigidly secured to vehicle 10, a cable guide tube 24 (FIGS. 1 and 3) rigidly mounted on and extending through plate 23, and a cable support roller 25 rotatably mounted on plate 23. Tube 24 ensures that cable 22 always pays onto or off of a cable drum 30 of winch assembly 12 at a constant tangential angle.

Figure 2:
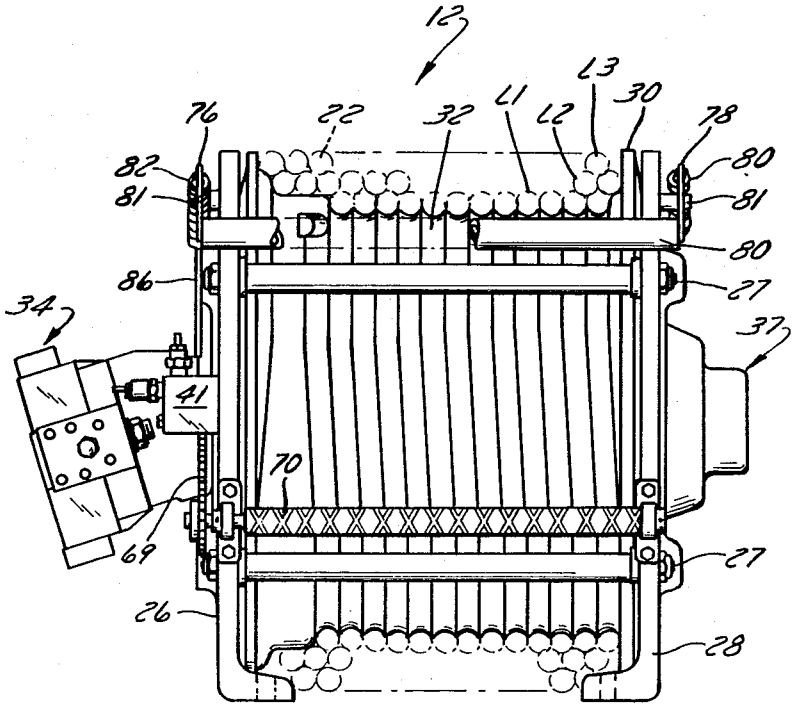
FIG. 2 is an enlarged front elevation view of a retrieval winch for the recovery vehicle of FIG. 1.
Figure 5:
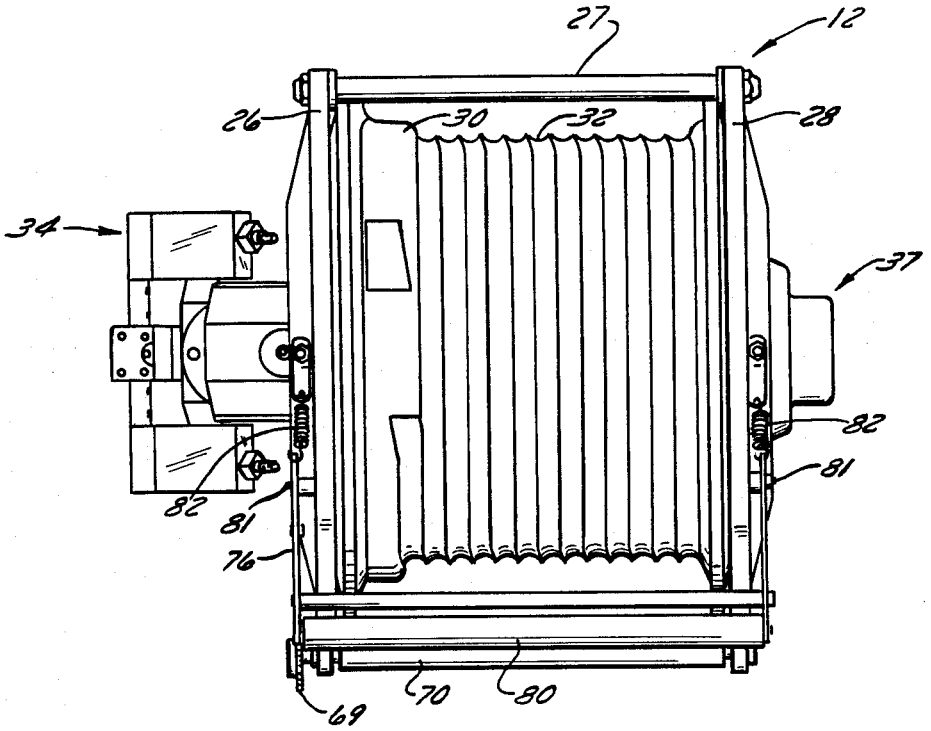
FIG. 5 is a top plan view of the winch of FIG. 2.
Figure 4:
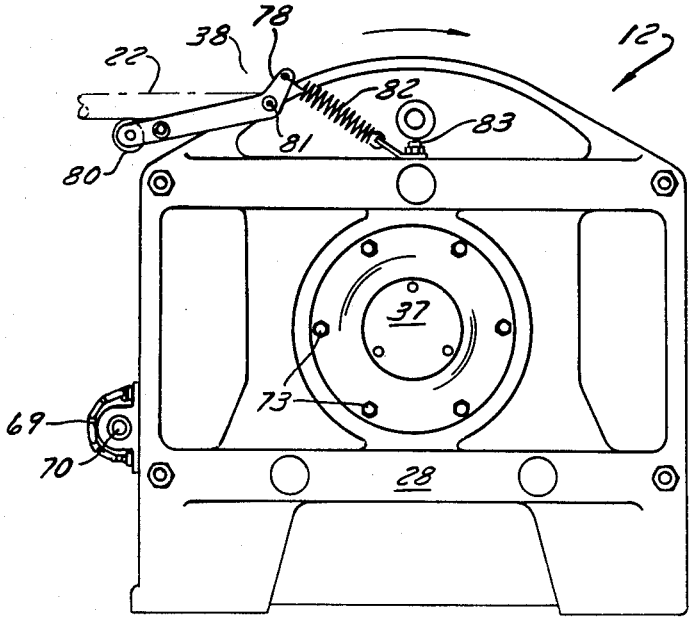
FIG. 4 is an elevation view of the right side of the winch of FIG. 2.
Figure 6:
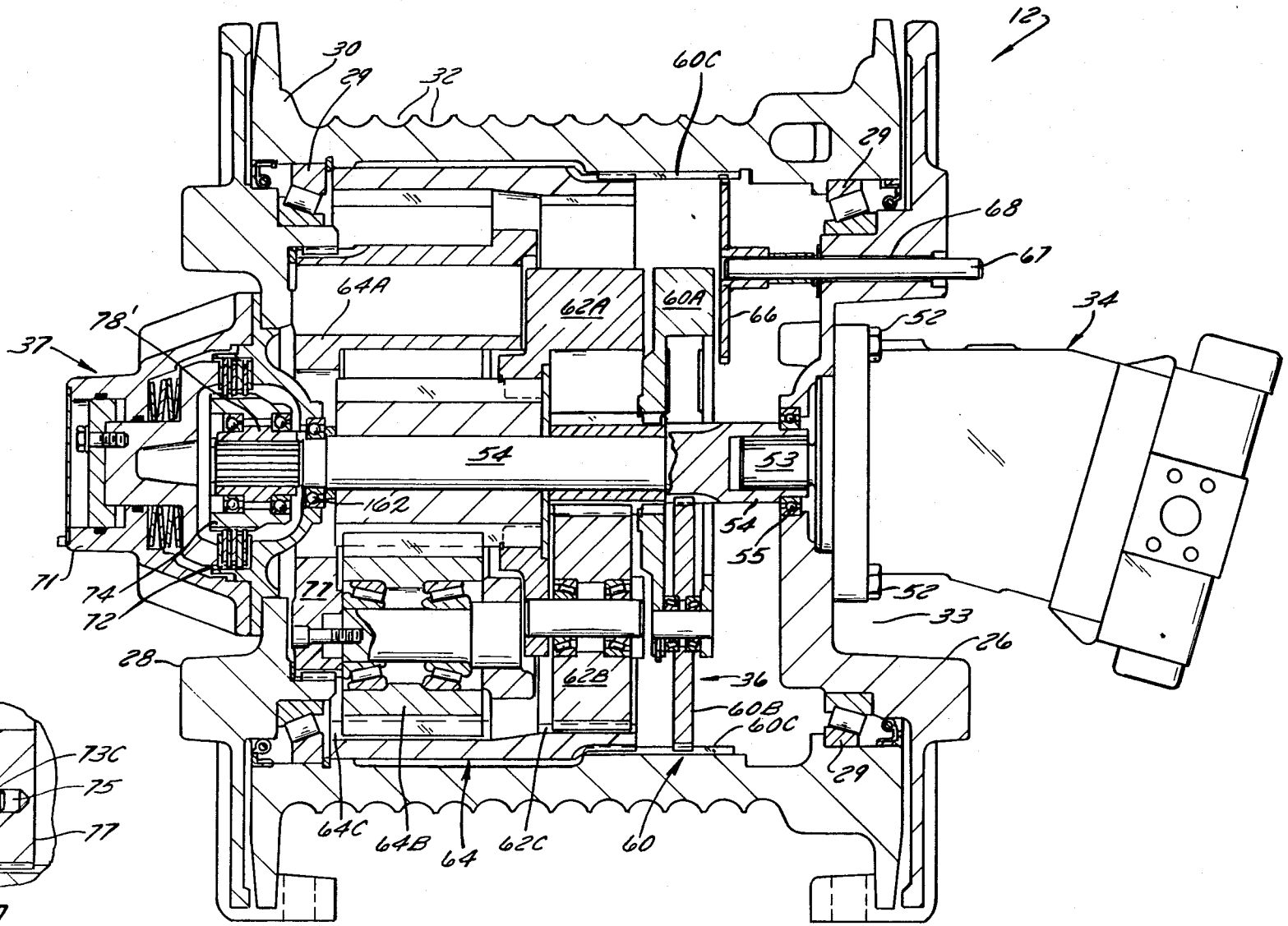
FIG. 6 is an enlarged reversed cross-section view of the winch shown in FIG. 2.

As FIGS. 2–10 show, the interior components of main winch assembly 12 generally include a winch support structure, a winch drum 30, winch cable 22, a winch motor 34, a power transmission mechanism 36, a winch brake assembly 37, and control means. The winch support structure comprises a pair of laterally spaced apart rigid stationary support members 26 and 28 interconnected by cross-members 27. A hollow cylindrical winch drum 30 is rotatably mounted on the support members 26 and 28 by means of a plurality of bearing assemblies 29 (FIG. 6) and embodies a plurality of parallel stacking double cross-over grooves 32 (FIGS. 2, 5 and 6). Winch cable 22 has one end connected to drum 30 (FIG. 11) and its other opposite end connected to vehicle 16 (FIG. 1) and is adapted to be wrapped in a plurality of layers (L1, L2, L3) around drum 30 (FIGS. 2 and 11). The hydraulic reversible variable displacement winch motor 34 is angularly mounted on support member 26 within an inwardly-extending recess 33 thereon (FIG. 6). The multi-stage power transmission mechanism 36, including a transmission drive shaft 54, is disposed within drum 30 and operatively connected between winch motor 34 and drum 30 (FIG. 6). The hydraulically operated winch brake assembly 37 is mounted on support member 28 and connected to transmission mechanism 36. The control means for operating winch motor 34 (and brake assembly 37) in accordance with the present invention comprises a displacement control circuit 59 (FIG. 10), a cable layer sensing means or mechanism 38 (FIGS. 2–5 and 10) and a hydraulic control circuit 40 (FIG. 10), including a constant line pull valve assembly 99, responsive to sensing mechanism 38 for controlling winch motor 34.

Figure 10:
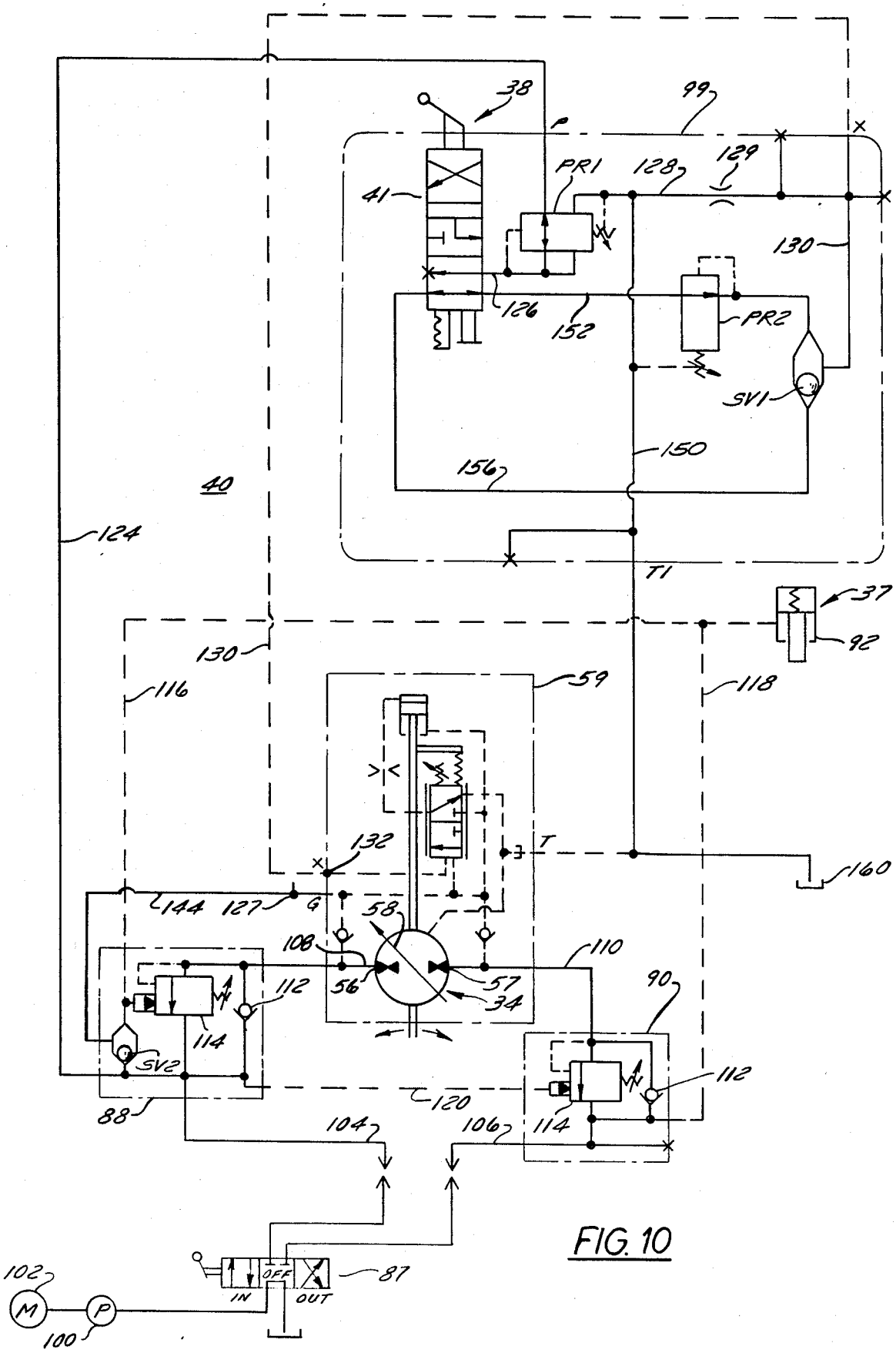
FIG. 10 is a schematic diagram of the hydraulic winch motor and a hydraulic control circuit therefor in accordance with the present invention.
Figure 12:
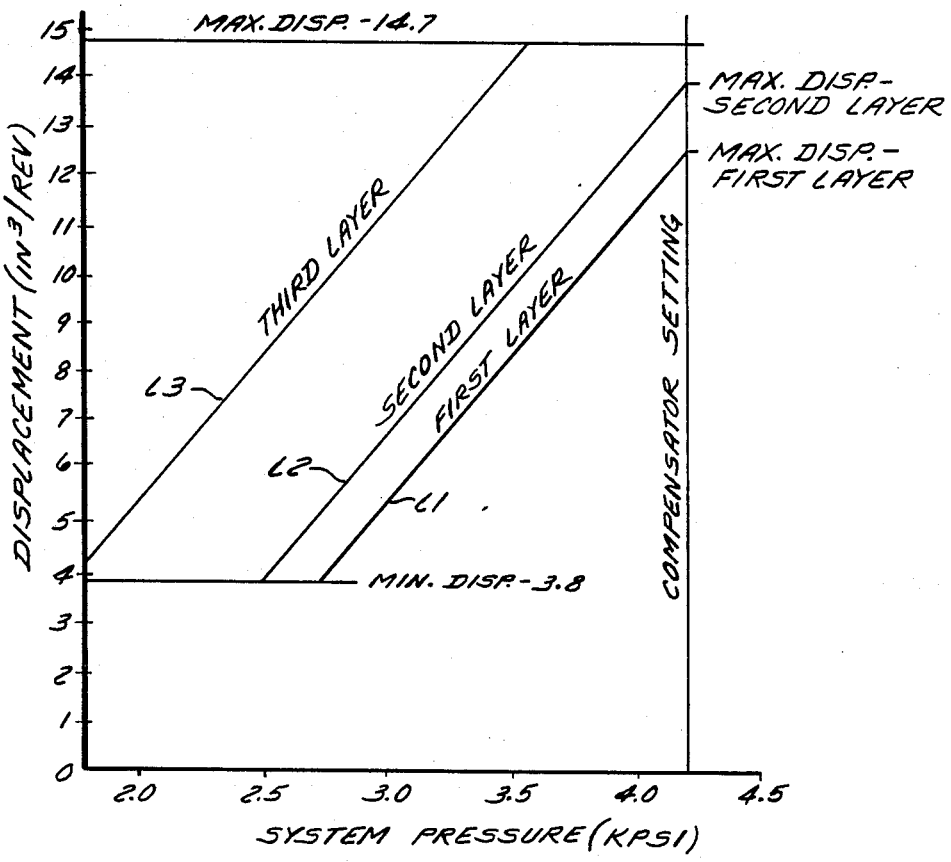
FIG. 12 is a graph depicting the operating characteristics of the hydraulic motor and the hydraulic control circuit of FIG. 10 under various operating conditions.
Figure 11:
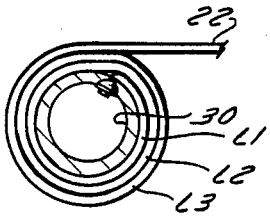
FIG. 11 is a schematic cross-section view (not to scale) of the winch cable drum showing three layers of winch cable wrapped thereon.

Referring to FIGS. 2, 3, 5, 6, 8, 9 and 10, hydraulic winch motor 34 comprises a housing 50 which is rigidly secured to support plate 26 by bolts 52 and also comprises a rotatable motor shaft 53 which is rigidly secure by a splined connection to one end of transmission drive shaft 54 (FIG. 6). Shaft 54 is rotatably supported at one end on a bearing 55 on support member 26 and at its other end by a bearing 162 on brake assembly 37. It is to be understood, for example, that 300 rpm of motor shaft 53 and transmission drive shaft 54 effect 1 rpm of winch drum 30 as a result of the operation of multi-stage power transmission mechanism 36, hereinafter described. As FIG. 10 shows, winch motor 34 further comprises inlet/outlet ports 56 and 57, a swash plate 58 adjustably movable to vary motor displacement, and a pressure sensitive internal hydraulic circuit 59 which effects increased displacement to reduce motor speed and increase motor torque and vice-versa. As will be understood, fluid flow across the motor ports 56 and 57 is normally constant when motor 34 is in operation. The displacement of motor 34 can be varied by varying the fluid pressure at a control override port 132 (FIG. 10) of the internal hydraulic control system 59 of motor 34. An increase in displacement effects a decrease in motor speed and an increase in motor torque. A decrease in displacement effects an increase in motor speed and a decrease in motor torque. As hereinafter explained in detail, in order to maintain a constant predetermined pulling force on cable 22 as each cable layer L1, L2, L3 (FIGS. 2 and 11) is formed on drum 30, the pressure at port 132 is varied. For example, a pressure of zero psi is maintained at port 132 when forming cable layer L1, a pressure of 77 psi is maintained at port 132 when forming cable layer L2, and a pressure of 310 psi is maintained at port 132 when forming cable layer L3. As the graph in FIG. 12 shows, winch motor 34 has, for example, a minimum displacement of 3.8 cubic inches per revolution and a maximum displacement of 14.7 cubic inches per revolution and accommodates fluid at a pressure range between 2000 and 4200 pounds per square inch. Winch motor 34 may, for example, take the form of a Type AA6VM - Series 60 variable displacement piston motor which is commercially available from the REXROTH World Wide Hydraulic Company and described in that Company's Bulletin RA 06165, issued 6/86.

Referring now to FIG. 6, power transmission mechanism 36 comprises three planetary gear stages, including an input gear stage 60, an intermediate gear stage 62 and an output gear stage 64. Each of the three gear stages 60, 62 and 64 directly drive winch drum 30.

Input gear stage 60 comprises a planet carrier 60A on drive shaft 54 and planetary gears 60B thereon which drivingly engage a first ring gear 60C formed on the inside surface of winch drum 30.

Intermediate gear stage 62 comprises a pinion gear 62A driven by pinion gear 60A and planetary gears 62B thereon which drivingly engage a second ring gear 62C formed on the inside surface of winch drum 30.

Output gear stage 64 comprises a pinion gear 64A driven by pinion gear 62A and planetary gears 64B thereon which drivingly engage a third ring gear 64C formed on the inside of winch drum 30.

First ring gear 60C meshes with a gear 66 affixed to a shaft 67 which is rotatably supported by a bearing 68 on support member 26 (FIG. 6). Shaft 67 rotatably drives an endless link chain 69 (FIGS. 2–5) which effects rotation of a diamond screw 70 to properly guide cable 22 onto and off of winch drum 30.

Figure 7:
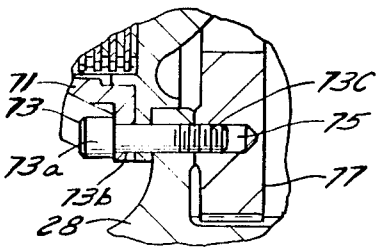
FIG. 7 is an enlarged view of a detail taken on line 7—7 of FIG. 6.
Figure 8:
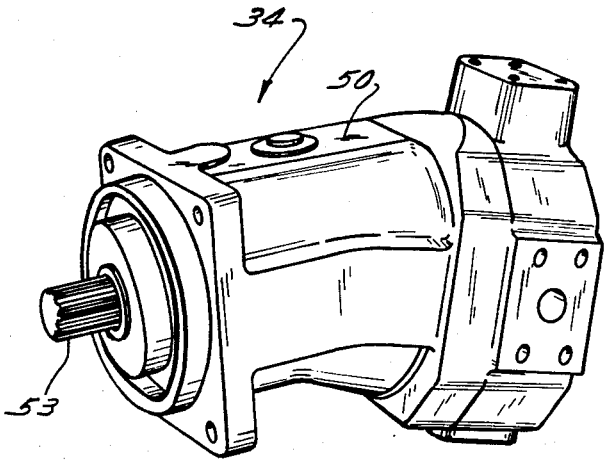
FIG. 8 is an enlarged perspective view of the hydraulic winch motor shown in FIGS. 2, 3, 5 and 6.
Figure 9:
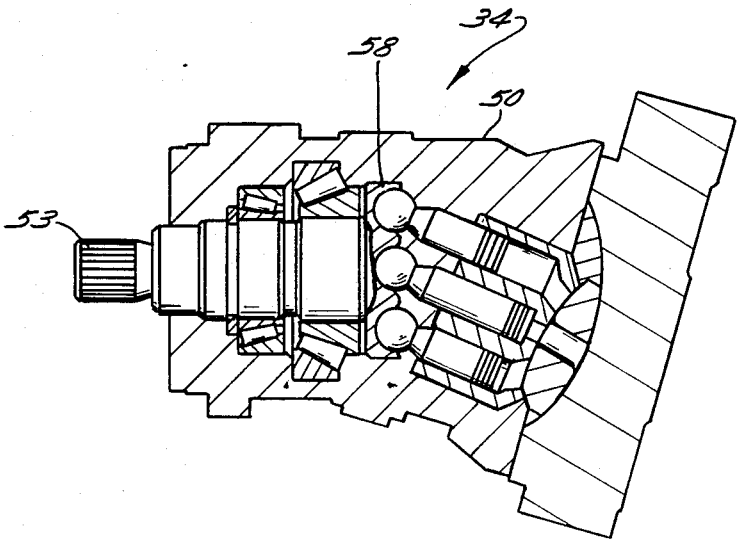
FIG. 9 is an enlarged cross-section view of the winch motor shown in FIG. 8.

Referring to FIG. 6, hydraulically operated winch brake assembly 37 comprises a brake housing 71 in which are located a stationary brake disc assembly 72 mounted on support member 28 and an interleaved rotatable brake disc assembly 74 mounted on sprag clutch assembly 78′ which is in turn mounted on the end of transmission drive shaft 54. Fixed assembly 72 is connected to and supported by brake housing 71. Rotatable assembly 74 is connected to, supported by and rotatable with the sprag clutch assembly 78′ which is supported by and rotatable with the other splined end of power transmission shaft 54. Brake housing 71 is connected to support member 28 by a plurality of bolts 73 (FIGS. 4 and 7) which extend into bolt-receiving bores 75 (FIG. 7). Each such bore 75 is formed in brake housing 71, in support member 28 and in a stationary member 77 forming part of the last stage 64 of power transmission mechanism 36 so as to enhance the strength of the mechanical connection of brake housing 71 to its associated support plate 28 and member 77 without sacrificing winch width compactness. Each bore 75 extends inwardly parallel to the axis of rotation of power transmission shaft 54 (see line 7—7 in FIG. 6) and accommodates a bolt with a longer threaded section than would otherwise be possible, while at the same time preventing interference between the bolt and the nearby movable (rotatable) component 64B in power transmission mechanism 36. Bolt-receiving bore 75 extends entirely through a portion of predetermined thickness of brake housing 71, a portion of predetermined thickness of support member 28 and extends partially through a portion of predetermined thickness of stationary member 77, that part of the bore in members 28 and 77 being threaded. Bolt 73 has a head 73*a*, a bolt shank 73*b* disposed in bore 75 and a threaded shank portion 73*c* engaged with the threaded part of bore 75.

Referring to FIGS. 2–5, the cable layer sensing mechanism 38, which is part of the control means hereinafter described, comprises a pair of bell cranks or levers 76 and 78 which are pivotally mounted on the support members 26 and 28, respectively, by pivot pins 81. A sensing member in the form of an elongated roller 80 is rotatably supported between one arm of the bell cranks 76 and 78 and is adapted to engage the underside of that portion of cable 22 which extends from drum 30. The other arm of each bell crank 76, 78 is connected to one end of a respective helical tension spring 82 which is anchored by a bolt 83 to a respective support member 26, 28 and operates to bias roller 80 against the underside of cable 22. As the number of cable layers on drum 30 increase or decrease, the roller 80 moves up or down and the bell cranks 76 and 78 correspondingly pivot. Bell crank 76 is connected to operate diversion valve 41 (FIGS. 2, 3 and 10) in constant line pull valve assembly 99 by means of a push/pull rod 86.

Referring to FIGS. 10, 11 and 12, the control means will now be described. The control means generally comprises: a hydraulic control circuit 40 for motor 34 and brake assembly 37 and the sensing mechanism 38. Hydraulic control circuit 40 comprises the internal hydraulic motor control circuit 59 for motor 34 and the constant line pull valve assembly 99 which includes the diversion valve 41, a first pressure reducing valve PR1, a second pressure reducing valve PR2, and a main shuttle valve SV1. The hydraulic control circuit 40 further comprises a direction selector valve 87, a pull-in counterbalance valve 88 and a pay-out counterbalance valve 90.

Hydraulic fluid for operating winch motor 34 is supplied by means of a pump 100 driven by a motor 102 to direction selector valve 87. Selector valve 87, which may be manually operable, has three positions, namely: off, pay-out cable, and pull-in cable. Selector valve 87, as depicted, admits a constant flow across motor ports 56 and 57 in its pay-out and pull-in positions, but could take the form of a valve in which flow could be selectively varied to thereby vary the speed/torque characteristics of motor 34.

Selector valve 87 is connectable to the inlet/outlet ports of valves 88 and 90 by fluid lines 104 and 106, respectively, and those valves are connected to the inlet/outlet ports 56 and 57, respectively, of winch motor 34 by fluid lines 108 and 110, respectively.

Each counterbalancing valve 88, 90 comprises a one-way check valve 112 and a pressure responsive valve 114. The counterbalancing valves 88 and 90 are connected by fluid lines 116 and 118, respectively, to brake cylinder 92 of brake assembly 37. The counterbalancing valves 88 and 90 are connected to each other by a fluid pressure balancing line 120.

Pull-in counterbalancing valve 88 further comprises an internal shuttle valve SV2 which is connected by a fluid pressure line 124 to pressure reducing valve PR1. Pressure reducing valve PR1 is connected by a fluid line 126 to diversion valve 41. Diversion valve 41 is operated by rod 86 in response to the position of roller 80 which engages winch cable 22 and, therefore, is able to sense whether one, two or three cable layers L1, L2 and L3, respectively, are disposed on cable drum 30 (see FIG. 11). Diversion valve 41 is a three-position hydraulic valve. In its first position (shown in FIG. 10) which it assumes, when motor 34 operates in the cable pull-in mode and a first cable layer L1 is being wound on cable drum 30, diversion valve 41 blocks fluid flow therethrough from pressure reducing valve PR1. In its second position which it assumes when a second cable layer L2 is being wound on cable drum 30, diversion valve 41 permits fluid flow therethrough from pressure reducing valve PR1 through a fluid line 152 to pressure reducing valve PR2 and from thence through main shuttle valve SV1 and through a fluid line 130 to control override port 132 of internal hydraulic circuit 39 of motor 34. In its third position which it assumes when a third cable layer L3 is being wound on cable drum 30, diversion valve 41 permits fluid flow therethrough from pressure reducing valve PR1, through a fluid line 156 (thereby by-passing pressure reducing valve PR2), through main shuttle valve SV1 and through fluid line 130 to control override port 132.

Operation

Operation of the main winch assembly 12 of recovery vehicle 10 will now be described. Initially, assume that recovery vehicle 10 is stationary on firm terrain and that its spade 18 is firmly dug in. Also assume that the immobilized vehicle 16 to be recovered is located in soft terrain and at a distance which is slightly less than the full length of cable 22 wound on winch cable drum 30 of recovery vehicle 10.

The human operator in recovery vehicle 10 manually moves selector valve 87 from off position to pay-out position so as to rotate cable drum 30 in the pay-out direction and personnel outside recovery vehicle 10 carry the free end of the cable to vehicle 16 and attach it thereto. Selector valve 87 is returned to off position when the desired amount of cable is payed out.

When selector valve 87 is moved from off to pay-out position, pressurized fluid flows from pump 100, through line 106 to pay-out counterbalance valve 90. Pressurized fluid then flows from valve 90 through line 118 to effect release of drum brake assembly 37 to thereby enable rotation of drum 30. Simultaneously, pressurized fluid opens and flows through check valve 112 of valve 90 and through line 110 into port 57 of winch motor 34 to cause it and drum 30 to rotate in the pay-out direction. Fluid is then exhausted from port 56 of winch motor 34 through line 108, through pressure responsive valve 114 of counter-balancing valve 88, and through line 104. Fluid pressure in line 108 causes valve 114 to open. Fluid pressure in line 104 is sensed through line 120 and regulates pressure responsive valve 114 of valve 90 so that fluid flow into and out of motor 34 is balanced. Motor 34 is normally at minimum displacement (minimum torque and maximum speed), but is automatically adjusted toward maximum displacement (maximum torque and minimum speed) in response to an increasing pilot pressure fluid signal supplied to a port 127 of internal hydraulic circuit 59 of motor 34. When selector valve 87 is returned from pay-out position to off position, winch motor 34 stops and winch brake assembly 37 moves from released to brake-engaged position.

Now assume that the free end of cable 22 is attached to vehicle 16, that no cable layer is wrapped on drum 30, and that it is desired to reel in cable 22, while recovery vehicle 10 remains stationary, by operating winch assembly 12 so as to exert a sufficient pulling force on the cable and to reel it in at the maximum speed available as limited by hydraulic power supplied.

The human operator in recovery vehicle 10 manually moves selector valve 87 from off to pull-in position so as to rotate cable drum 30 in the pull-in direction and move vehicle 16.

When selector valve 87 is moved from off to pull-in position, pressurized fluid flows from pump 100, through line 104 to pull-in counterbalance valve 88. The brake, which moved to an engaged position when the selector valve 87 was returned from its pay-out to its off position as previously described, is not released. However, rotation of drum 30 in a reel-in direction is enabled by a sprag (one-way) clutch 78' (FIG. 6). is enabled by a sprag (one-way) clutch 78 (FIG. 6).

Simultaneously, pressurized fluid from line 104 flows through shuttle valve SV2 and through a line 144 to port 127 of internal circuit 59 of motor 34 thereby enabling motor 34 to operate at some predetermined displacement, unless that displacement is altered and overridden by a fluid pressure signal at override control port 132, as hereinafter explained.

Simultaneously, pressurized fluid flows through check valve 112 of valve 88 and through line 108 into port 56 of winch motor 34 to cause it and drum 30 to rotate in the pull-in direction. Fluid is exhausted from port 57 of motor 34 through line 110, through valve 114 of counterbalancing valve 90, and through line 106. Fluid pressure in line 104 is sensed through line 120 and opens pressure responsive valve 114 of valve 90 so that fluid flow into and out of motor 34 is balanced.

Simultaneously, pressure fluid flows from line 104 through line 124 to pressure reducing valve PR1 of constant line pull valve assembly 99. As soon as drum 30 starts its rotation, the cable layer sensing mechanism 38 detects that the first cable layer L1 is starting to form on cable drum 30 and, therefore, maintains diversion valve 41 in its first position (shown in FIG. 10). Fluid in line 124 is at relatively high pressure (see FIG. 12) and flows into pressure reducing valve PR1 wherein it normally undergoes a pressure drop, but, since it is unable to flow through diversion valve 41, zero control fluid pressure is applied to control override port 132 of internal hydraulic control circuit 59 of motor 34. With zero pressure at port 132, motor 34 operates at a displacement level sufficient to move the load and thus allow rotation of motor 34. System performance is as shown in the curve designated "First Layer" in FIG. 12. The specific pulling force exerted on cable 22 is determined by the hydraulic system pressure and the pressure sensing circuit 59 maintains a force appropriate to cable layer L1.

Cable layer sensing mechanism 38 detects when the second cable layer L2 starts to form and moves diversion valve 41 into its second position. Fluid in line 124 is now able to flow through first pressure reducing valve PR1 (wherein it undergoes a first pressure drop to 310 psi, for example), through diversion valve 41, through line 152, through second pressure reducing valve PR2 (wherein it undergoes a second pressure drop to 77 psi, for example), through main shuttle valve SV1, and through line 130 to control override port 132. The pressure at port 132 (approximately 77 psi) causes motor 34 to operate during formation of the second cable layer L2 at a displacement level sufficient to maintain the same pulling force and speed on cable 22 provided during formation of the first cable layer L1, as shown in the curve designated "Second Layer" in FIG. 12.

Cable layer sensing mechanism 38 detects when the third cable layer L3 starts to form and moves diversion valve 41 into its third position. Fluid in line 124 is now able to flow through first pressure reducing valve PR1, wherein it drops to 310 psi, for example, through diversion valve 41, through line 156, through main shuttle valve SV1 and through line 130 to control override port 132. However, the second pressure reducing valve PR2 is by-passed and the fluid at port 132 has undergone only the pressure drop effected by first pressure reducing valve PR1, to approximately 310 psi. The pressure at port 132 causes motor 34 to operate during formation of the third cable layer L3 at a displacement level sufficient to maintain the same pulling force and speed on cable 22 provided during formation of the first and second cable layers L1 and L2, respectively.

When the cable 22 is reeled in and vehicle 16 is moved to the extent desired, selector valve 87 is returned from pull-in position to off position, winch motor 34 stops and winch brake 32 moves from released to brake-engaged position.

It is to be noted that a fluid line 128 having a metering orifice 129 therein is connected between line 130 and a line 150 connected to a reservoir 160. Fluid is thus able to bleed out of line 130 (which supplies control override port 132) when line 130 is no longer being positively supplied through line 124 from the upstream components (i.e., pull-in counterbalance valve 88, etc.).

I claim:

1. In combination:

a rotatable winch drum adapted to have a plurality of layers of cable wrapped therearound;

said cable being connected to said drum and connectable to a load;

a motor including a motor control means connected to a rotatable drive said drum in a direction wherein said drum exerts a pulling force on said cable;

said motor being of a type wherein motor torque delivered to said drum can be varied;

sensing means for providing an indication of the number of cable layers wrapped around said drum;

a source of variable pressure hydraulic fluid;

hydraulic control means having a connection to the hydraulic fluid source and operative independently of the motor and motor control means and responsive to the sensing means to produce a plurality of discrete hydraulic pressure values in said fluid, each pressure value being indicative of a different one of the cable layers; and said motor control means is connected to the hydraulic control means and is operable in response to said hydraulic pressure values to vary the torque of said motor in accordance with each one of the discrete pressure values so as to maintain a predetermined constant maximum pulling force on said cable and said load regardless of the number of layers of cable wrapped around said drum.

2. The combination according to claim 1 wherein:

said motor is of a hydraulic type connected to said hydraulic fluid source; and the hydraulic control means maintains the plurality of discrete pressure values, relative to each other, independent of the pressure variation of the hydraulic fluid source.

3. A cable winch comprising:

a pair of spaced apart support members, one of which as an inwardly extending recess formed on the outside thereof;

a hollow cylindrical cable drum rotatably mounted on said support members and adapted to have a plurality of layers of cable wrapped therearound;

a motor for effecting rotation of said drum and mounted on said one support member within said recess;

power transmission means located within said hollow drum and including a transmission drive shaft rotatably mounted on said support members and connected to be rotatably driven by said motor and further including a multi-stage power transmission mechanism operatively connected between said drive shaft and the inside of said hollow drum;

each stage of said multi-stage transmission mechanism having gears which mesh with one of plurality of ring gears mounted on the interior of said hollow drum;

and sensing means for sensing the number of layers of cable wrapped on said drum and to effect operation of said motor in accordance therewith;

said sensing means comprising a sensing member disposed beneath a cable extending from said drum and movably supported on at least one support member and adapted for connection to a motor control, said sensing means further comprising means for biasing said sensing member upwards into engagement with a cable extending from said drum so that a change in the number of layers of cable on said drum effects movement of said sensing member.

4. A cable winch having upper, lower, front, rear and lateral sides and an axis extending between said lateral sides, said winch comprising:

a supporting structure including a pair of rigid support members spaced apart from each other along said axis and located at said lateral sides of said winch;

one of said support members having a recess extending inwardly from a lateral side of said winch;

said support structure further comprising rigid support rods connected between said pair of rigid support members;

a hollow cylindrical cable drum disposed between said pair of support members and rotatably supported thereon for rotation about said axis;

said cable drum being adapted to have a plurality of layers of cable wrapped therearound;

a motor for effecting rotation of said drum mounted on said one support member within said recess;

power transmission means located within said drum and operatively connected between said motor and said drum, said power transmission means comprising:

a transmission drive shaft rotatably supported between and by said pair of support members on said axis, said transmission drive shaft having one end connected to be rotatably driven by said motor and having an opposite end, and a multi-stage transmission mechanism operatively connected between said transmission drive shaft and the interior of said drum;

a brake assembly mounted on the other of said pair of support members and operatively connected to said opposite end of said transmission drive shaft;

means for guiding a cable onto and off of said drum and including a diamond screw rotatably mounted on said pair of support members on said front side of said winch and a drive mechanism mounted on said one support member and operatively connected between said power transmission mechanism and said diamond screw to effect rotation;

and means for sensing the number of layers of cable wrapped on said drum comprising:

a lever pivotally mounted on at least one of said support members, a roller rotatably mounted on the lever and disposed beneath and in engagement with a cable extending from said drum, biasing means connected to said lever for biasing said roller upwards against a cable extending from said drum, and a control-actuating member connected to and movable by said lever in response to a change in the number of layers of cable wrapped on said drum.

5. A cable winch comprising:

a pair of spaced apart support members, one of which has an inwardly extending recess formed on the outside thereof;

a hollow cylindrical cable drum rotatably mounted on said support members and adapted to have a plurality of layers of cable wrapped therearound;

a motor for effecting rotation of said drum and mounted on said one support member within said recess;

a brake assembly mounted on the other of said pair of support members and operatively connected to said transmission drive shaft to releasably brake rotation of said drum, the brake assembly including a housing having a portion of predetermined thickness;

power transmission means located within said hollow drum and including a transmission drive shaft rotatably mounted on said support members and connected to be rotatably driven by said motor and further including a multi-stage power transmission mechanism operatively connected between said drive shaft and the inside of said hollow drum, each stage of said multi-stage transmission mechanism having gears which mesh with one of a plurality of ring gears mounted on the interior of said hollow drum;

one stage of said multi-stage transmission including a stationary component and a movable component closely adjacent said stationary component, the stationary component having a portion of predetermined thickness contiguous to a portion of said one support member of predetermined thickness;

attachment means including a bolt-receiving bore extending entirely through said portions of predetermined thickness of said brake housing and said one support member and extending partially through said portion of predetermined thickness of said stationary component, that part of the bore in said support member and in said component being threaded, said bolt-receiving bore being parallel relative to said transmission drive shaft, said attachment means further including a bolt having a head, a bolt shank disposed in said bore and a threaded shank portion engaged with the threaded part of said bore; and sensing means for sensing the number of layers of cable wrapped on said drum and to effect operation of said motor in accordance therewith, said sensing means comprising a sensing member movably supported on at least one support member and adapted for connection to a motor control, said sensing means further comprising means for biasing said sensing member into engagement with a cable extending from said drum so that a change in the number of layers of cable on said drum effects movement of said sensing member.

6. In combination:

a rotatable winch drum adapted to have a plurality of layers of cable wrapped therearound;

said cable being connected to said drum and connectable to a load;

a motor including a motor control means connected to rotatably drive said drum in a direction wherein said drum exerts a pulling force on said cable;

said motor being of a type wherein motor torque delivered to said drum can be varied;

sensing means for providing an indication of the number of cable layers wrapped around said drum;

a source of pressurized hydraulic fluid;

hydraulic control means including a plurality of valve means having a connection to the hydraulic fluid source and being operative independently of the motor and motor control means and responsive to the sensing means for producing a plurality of discrete hydraulic pressure values in said fluid, each pressure value being indicative of a different one of the cable layers; and said motor control means is connected to the plurality of valve means and is operable in response to said hydraulic pressure values to vary the torque of said motor so as to maintain a predetermined constant maximum pulling force on said cable and said load regardless of the number of layers of cable wrapped around said drum.

7. The combination according to claim 6 wherein the plurality of valve means have first, second and third conditions each producing a different one of said pressure values.

8. The combination according to claim 6 wherein:

the source of pressurized hydraulic fluid is variable from a minimum to a maximum value;

the motor is of a hydraulic type having a plurality of preselected maximum displacement values and is connected to the source of pressurized hydraulic fluid;

the motor is movable to a different one of the plurality of maximum displacement values in response to the maximum value of pressurized hydraulic fluid and a different one of the plurality of discrete hydraulic pressure values;

the motor has a plurality of different maximum torque values corresponding to each different one of the plurality of the maximum displacement values at the maximum value of pressurized hydraulic fluid; and each different maximum torque value has a value and is applied to rotate the drum while a different number of the plurality of cable layers is wrapped around the drum such that said constant maximum pulling force is maintained on the cable.

9. The combination according to claim 8 wherein:

said pulling force imparts a tension in said cable; and the torque of the motor is independent of the cable tension.

* * * * *